US012221975B2

(12) United States Patent
Lee et al.

(10) Patent No.: US 12,221,975 B2
(45) Date of Patent: Feb. 11, 2025

(54) IMPELLER

(71) Applicant: Delta Electronics, Inc., Taoyuan (TW)

(72) Inventors: Chin-Hung Lee, Taoyuan (TW); Chieh-Hung Chang, Taoyuan (TW); Chieh-Shih Chang, Taoyuan (TW); Ya-Ting Chang, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 18/116,695

(22) Filed: Mar. 2, 2023

(65) Prior Publication Data

US 2023/0279868 A1 Sep. 7, 2023

(30) Foreign Application Priority Data

Mar. 4, 2022 (CN) ..... 202220453457.8

(51) Int. Cl.
*F04D 29/30* (2006.01)
*F04D 29/28* (2006.01)
*F04D 29/32* (2006.01)

(52) U.S. Cl.
CPC ..... *F04D 29/282* (2013.01); *F04D 29/30* (2013.01); *F04D 29/327* (2013.01)

(58) Field of Classification Search
CPC ..... F04D 17/16; F04D 19/002; F04D 29/326; F04D 29/327; F04D 29/282; F04D 29/30
See application file for complete search history.

(56) References Cited

U.S. PATENT DOCUMENTS

| | | | | |
|---|---|---|---|---|
| 6,877,954 | B2 * | 4/2005 | Lin | F04D 29/30 416/185 |
| 8,007,232 | B2 * | 8/2011 | Hwang | F04D 29/281 415/206 |
| 8,109,731 | B2 * | 2/2012 | Keber | F04D 29/281 416/186 R |
| 11,028,524 | B2 | 6/2021 | Qingdao | |
| 11,286,947 | B2 * | 3/2022 | Horng | F04D 29/542 |
| 11,454,249 | B2 * | 9/2022 | Chen | F24F 7/007 |
| 2007/0098571 | A1 * | 5/2007 | Nagamatsu | F04D 29/281 417/354 |
| 2021/0071681 | A1 * | 3/2021 | Hsu | F04D 29/666 |

FOREIGN PATENT DOCUMENTS

| | | | |
|---|---|---|---|
| JP | 2021088989 | A | 6/2021 |
| TW | M429908 | U | 5/2012 |
| TW | I398210 | B | 6/2013 |

* cited by examiner

*Primary Examiner* — David E Sosnowski
*Assistant Examiner* — Jason G Davis
(74) *Attorney, Agent, or Firm* — KIRTON McCONKIE; Evan R. Witt

(57) ABSTRACT

An impeller includes a hub, an outer ring, a plurality of first blades and a plurality of second blades. The plurality of first blades are arranged around the hub at intervals. Each of the plurality of first blades passes through the outer ring, extends inward from the outer ring, and is connected to the hub. The plurality of second blades are arranged around the hub at intervals. Each of the plurality of second blades passes through the outer ring. At least one of the plurality of second blades is disposed between the plurality of first blades. A length of each of the plurality of second blades is between 10% and 45% of a length of each of the plurality of first blades.

14 Claims, 8 Drawing Sheets

IMPELLER

CROSS-REFERENCE TO RELATED APPLICATION

This application claims priority to China Patent Application No. 202220453457.8, filed on Mar. 4, 2022. The entire contents of the above-mentioned applications are incorporated herein by reference for all purposes.

FIELD OF THE INVENTION

The present disclosure relates to an impeller, and more particularly to an impeller having a plurality of main blades and a plurality of auxiliary blades with different lengths.

BACKGROUND OF THE INVENTION

With increasing development of science and technology, a variety of electronic devices are developed toward minimization, high integration and high power. During operation of an electronic device, a great deal of heat is generated by the electronic components of the electronic device. If the heat fails to be effectively dissipated away, the elevated operating temperature may result in damage, short circuit or deteriorated performance of the electronic device. For effectively removing the heat, a heat-dissipating device, such as a fan, is usually installed within the electronic device to exhaust the heat to the surroundings.

In tradition, in order to improve the cooling efficiency of the fan, it is generally adopted to increase the speed of the fan, so as to achieve the effect of increasing the air pressure and air volume of the fan. However, when the rotation speed of the fan increases, the overall noise of the fan will also increase accordingly.

Please refer to FIG. 1. FIG. 1 is a schematic top view illustrating an impeller according to a prior art. As shown in FIG. 1, the impeller 1 of the conventional fan comprises a hub 10, an outer ring 11, and a plurality of blades 12, wherein one end of the plurality of blades 12 passes through the outer ring 11, and another end of the plurality of blades 12 couples with the hub 10. However, the circumference of the hub 10 is obviously much smaller than that of the outer ring 11, so that the blade density of the plurality of blades 12 at the region near the hub 10 is relatively high, that is, they are densely arranged. While the blade density of the plurality of blades 12 at the region near the outer ring 11 relatively loose, which means the distance between each blade 12 arranged on the outer ring 11 is relatively long, and the gap therebetween is relatively large. Therefore, when the fan runs at a high speed, due to the low blade density of the plurality of blades 12 at the outer ring 11, the air pressure will drop, the turbulent flow will be generated, and the overall noise will be increased.

Therefore, there is a need of providing an impeller to obviate the drawbacks encountered from the prior arts.

SUMMARY OF THE INVENTION

It is an object of the present disclosure to provide an impeller, which comprises a plurality of main blades and a plurality of auxiliary blades. By the special arrangements that at least one auxiliary blade is arranged between the two adjacent main blades, so as to increase the blade density at the outer ring of the impeller. Consequently, the air volume and air pressure of the fan is increased, and the overall noise is reduced.

It is another object of the present disclosure to provide an impeller, wherein a guiding portion is arranged on each of the plurality of auxiliary blades, so as to introduce the airflow into the fan quickly, and also to increase the air volume and air pressure of the fan.

It is another object of the present disclosure to provide an impeller, which comprises at least one inner ring, through the arrangement that the plurality of main blades pass through the inner ring, the structure strength of the impeller is enhanced, so that the fan can be more stable, and the vibration and the overall noise can also be reduced during operation.

In accordance with an aspect of the present disclosure, there is provided an impeller used in a fan. The impeller comprises a hub, an outer ring, a plurality of first blades and a plurality of second blades. The plurality of first blades are arranged around the hub at intervals. Each of the plurality of first blades passes through the outer ring, extends inward from the outer ring, and is connected to the hub. The plurality of second blades are arranged around the hub at intervals. Each of the plurality of second blades passes through the outer ring. At least one of the plurality of second blades is disposed between the plurality of first blades. A length of each of the plurality of second blades is between 10% and 45% of a length of each of the plurality of first blades.

In an embodiment, a connection end of each of the plurality of first blades is connected to a peripheral edge of the hub, and the connection end of each of the plurality of first blades has a fillet.

In an embodiment, each of the plurality of second blades is arranged between every two adjacent of the plurality of first blades.

In an embodiment, two of the plurality of second blades are arranged between every two adjacent of the plurality of first blades.

In an embodiment, the hub has an axis, any point of tangency on one side edge of each of the plurality of first blades forms a line with the axis, and an angle is defined between the line and a tangent line of the point of tangency, and the angle is from 0 to 75 degrees.

In an embodiment, the impeller includes an inner ring, the inner ring is arranged between the hub and the outer ring, and each of the plurality of first blades passes through the inner ring.

In an embodiment, the inner ring is arranged away from the hub, and a circumference of the inner ring is smaller than the outer ring, and greater than 70% of the outer ring.

In an embodiment, the impeller includes two inner rings, each of the plurality of first blades passes through the two inner rings, and the two inner rings are arranged away from the hub.

In an embodiment, each of the plurality of second blades includes a guiding portion, the guiding portion is an inclined plane, and is disposed on an inner end of each of the plurality of second blades.

In an embodiment, a thickness of each of the plurality of first blades is not greater than 0.2 mm, and a thickness of each of the plurality of second blades is not greater than 0.15 mm.

In accordance with an aspect of the present disclosure, there is provided an impeller used in a fan. The impeller comprises a hub, an outer ring, a plurality of first blades and a plurality of second blades. The plurality of first blades are arranged around the hub at intervals. Each of the plurality of first blades passes through the outer ring, extends inward from the outer ring, and is connected to the hub. The plurality of second blades are arranged around the hub at intervals. Each of the plurality of second blades passes through the outer ring. At least one of the plurality of second blades is disposed between the plurality of first blades. Each of the plurality of second blades includes a guiding portion, the guiding portion is an inclined plane, and is disposed on an inner end of each of the plurality of second blades.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
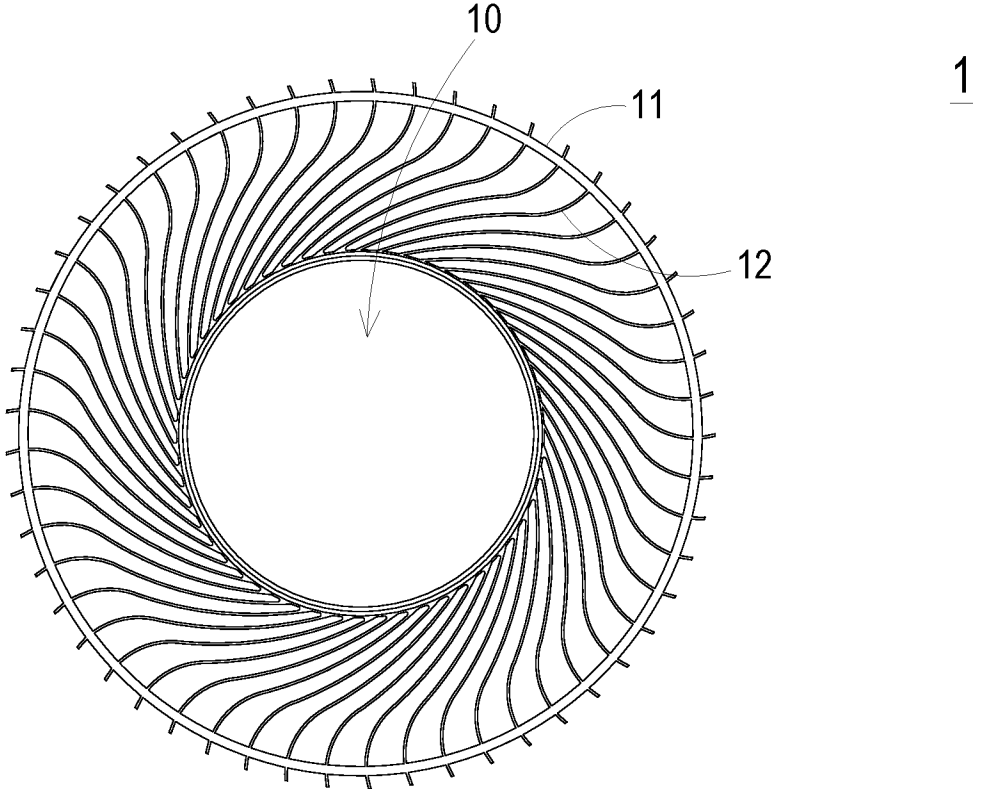
FIG. 1 PRIOR ART
FIG. 1 is a schematic top view illustrating an impeller according to a prior art.
Figure 2:
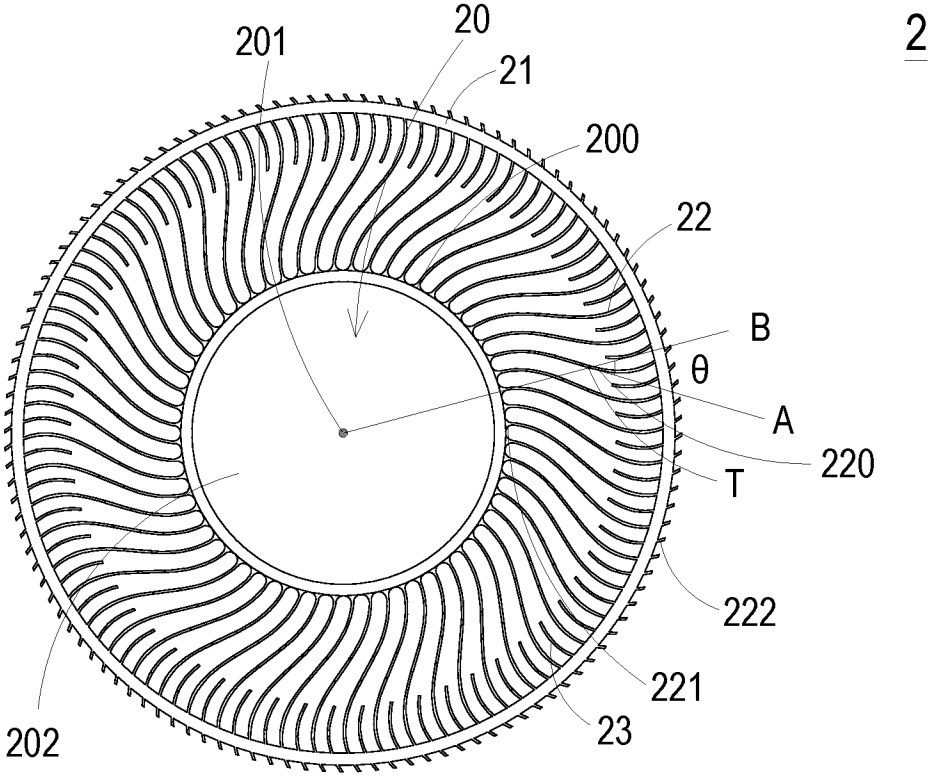
FIG. 2 is a schematic top view illustrating an impeller according to a first embodiment of the present disclosure.

FIG. 2 is a schematic top view illustrating an impeller according to a first embodiment of the present disclosure. As shown in FIG. 2, the impeller 2 of the present disclosure is used in a fan (not shown). The impeller 2 comprises a hub 20, an outer ring 21, a plurality of first blades 22 and a plurality of second blades 23. As shown in FIG. 2, the hub 20 is arranged at the center of the impeller 2, and has a circular shape. The outer ring 21 is a connection ring, which is arranged away from the hub 20, and the plurality of first blades 22 and the plurality of second blades 23 passes through the outer ring 21 in sequent. The plurality of first blades 22 are the main blades of the impeller 2, and are arranged around the hub 20 at intervals. One end of each of the plurality of first blades 22 is connected to a peripheral edge 200 of the hub 20, and another end of the plurality of first blades 22 passes through the outer ring 21, which extends inward from the outer ring 21, and is connected to the peripheral edge 200 of the hub 20. In the present disclosure, the first blade 22 can be an arc-shaped blade, but not limited to. The plurality of second blades 23 are the auxiliary blades of the impeller 2, and are arranged around the hub 20 at intervals. Each of the plurality of second blades 23 is arranged away from the peripheral edge 200 of the hub 20, which means each of the plurality of second blades 23 does not contact the peripheral edge 200 of the hub 20. However, one end of each of the plurality of second blades 23 still passes through the outer ring 21. In the present disclosure, the first blade 23 can be an arc-shaped blade, but not limited to. In this embodiment, each of the plurality of second blades 23 is arranged between every two adjacent of the plurality of first blades 22. It means in the embodiment, the number of the plurality of second blades 23 is the same as that of the plurality of first blades 22, thereby increasing the blade density of the blades at the outer ring 21. Consequently, the air volume and pressure are increased, and the noise is reduced. In some embodiments, the total number of the plurality of first blades 22 and the plurality of second blades 23 are from 37 to 100, but not limited thereto.

Please refer to FIG. 2 again. In this embodiment, the plurality of first blades 22 and the plurality of second blades 23 are arranged in staggered order and arranged around the hub 20. In the embodiment, the plurality of first blades 22 and the plurality of second blades 23 are arranged at equal distances from each other, but not limited thereto. In other embodiments, the plurality of first blades 22 and the plurality of second blades 23 may be arranged in unequal distances. The arrangements are not limited to the above embodiments, and can be adjustable according the practical requirement. Moreover, in the embodiment, the length of each of the plurality of second blades 23 is between 10% and 45% of the length of each of the plurality of first blades 22. In some embodiments, the thickness of each of the plurality of first blades 22 is not greater than 0.2 mm, and the thickness of each of the plurality of second blades 23 is not greater than 0.15 mm, but not limited to. In the embodiment, the height of each of the plurality of first blades 22 is the same as that of each of the plurality of second blades 23. However, the length, the thickness, and the height of the plurality of first blades 22 and the plurality of second blades 23 are not limited to the above embodiments, and can be adjustable according the practical requirement. As shown in FIG. 2, the hub 20 has an axis 201, any point of tangency T on one side edge 220 of each of the plurality of first blades 22 forms a line B with the axis 201, and an angle θ is defined between the line B and a tangent line A of the point of tangency T, wherein the angle θ is from 0 to 75 degrees.

Figure 3:
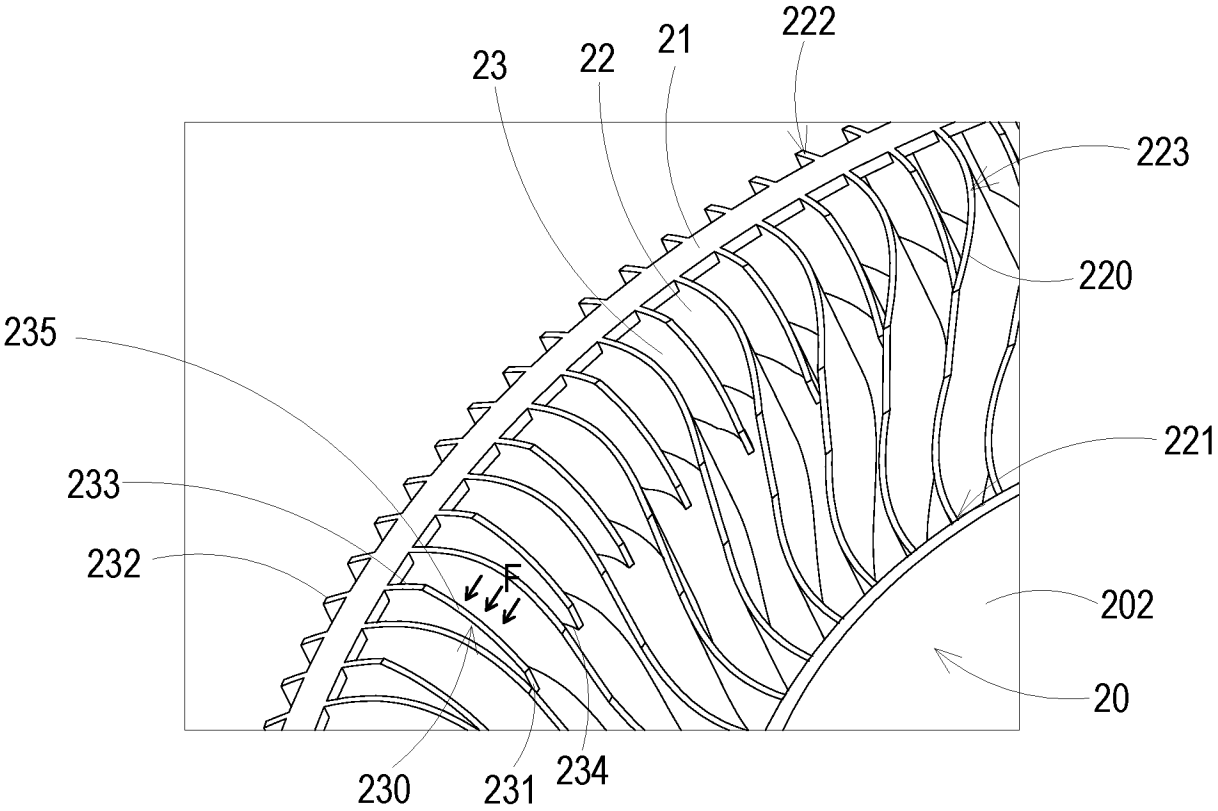
FIG. 3 is a partial enlargement schematic view of the impeller of FIG. 2A.

FIG. 3 is a partial enlargement schematic view of the impeller of FIG. 2A. Please refer to FIG. 2 and FIG. 3. The hub 20 has a first surface 202, and the first surface 202 can be but not limited to be an upper surface. In the embodiment, each of the plurality of first blades 22 has two ends, wherein one end is a connection end 221 coupled with the peripheral edge 200 of the hub 20, another end is a first front end 222, which is arranged away from the hub 20, and passes through the outer ring 21, and extends outward of the outer ring 21. As shown in FIG. 2, in some embodiments, the connection end 221 of each of the plurality of first blades 22 has a fillet, so as to increase the structure strength of the connection region, but not limited to. Besides, a first side 223 of the plurality of first blades 22 is defined as the same side as the first surface 202 of the hub 20, and the corresponding side is defined as a second side 224. In this embodiment, each of the plurality of second blades 23 also has two ends, wherein an inner end 231 faces the hub 20, but not in contact with the hub 20. Another end is the second front end 232, which is arranged away from the hub 20, and passes through the outer ring 21, and extends outward of the outer ring 21.

Please refer to FIG. 3. In some embodiments, each of the plurality of second blades 23 includes a guiding portion 230, the guiding portion 230 can be but not limited to be an inclined plane 235, which is disposed on the inner end 231 of each of the plurality of second blades 23. As shown in FIG. 3, the inclined plane 235 of the guiding portion 230 is extended obliquely downward from the first side 233 of the second blade 23 to form an oblique lead angle, so that the airflow can flow along the direction as shown by the Arrow F. Through the guiding of the oblique lead angle formed by the inclined plane 235, the airflow can be introduced into the impeller 2 and the fan quickly, so as to increase the air volume. In some other embodiments, the inclined plane 23 may be extended obliquely downward from the first side 233 of the second blade 23 till the second side 234, wherein the inclined angle, the inclined length of the guiding portion 230, or the types and the positions of the guiding portion 230 are not limited to the above embodiments, which can be adjustable according the practical requirement.

Figure 4:
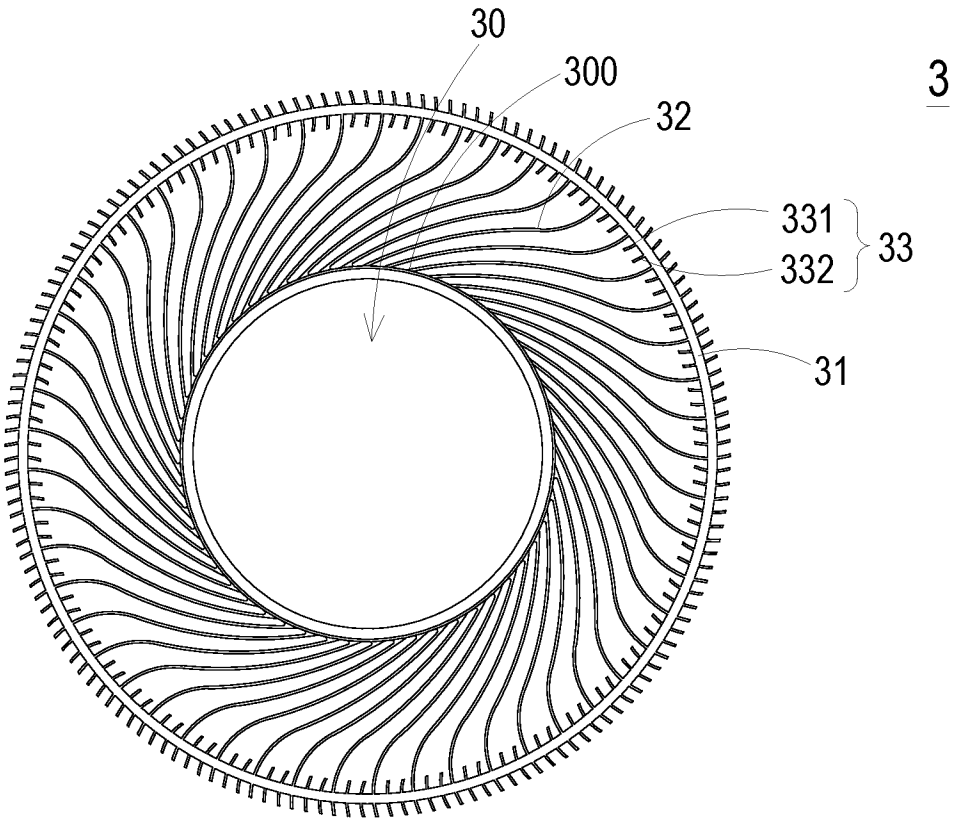
FIG. 4 is a schematic top view illustrating an impeller according to a second embodiment of the present disclosure.

FIG. 4 is a schematic top view illustrating an impeller according to a second embodiment of the present disclosure. In this embodiment, the impeller 3 comprises a hub 30, an outer ring 31, a plurality of first blades 32 and a plurality of second blades 33, wherein one end of each of the plurality of first blades 32 is connected to a peripheral edge 300 of the hub 30, and another end of the plurality of first blades 32 passes through the outer ring 31. In the embodiment, the structures and the arrangements of the hub 30, the outer ring 31, and the plurality of first blades 32 are similar to the first embodiment, and will not be redundantly repeated here. While, in the embodiment, the plurality of second blades 33 as the auxiliary blades are arranged between two adjacent of the plurality of first blades 32 in groups of two. In other words, the two of the plurality of second blades 331, 332 are arranged between every two adjacent of the plurality of first blades 32. Consequently, the total number of the plurality of second blades 33 is twice of the plurality of first blades 32, and the blade density at the outer ring 31 is increased through these doubled auxiliary blades, thereby increasing the air volume and air pressure, and reducing noise. In the embodiment, the total number of the plurality of first blades 32 and the plurality of second blades 33 are from 37 to 100, but not limited thereto. The length, the thickness, and the height of the plurality of first blades 32 and the plurality of second blades 33 are similar to the first embodiment, and will not be redundantly repeated here.

Figure 5A:
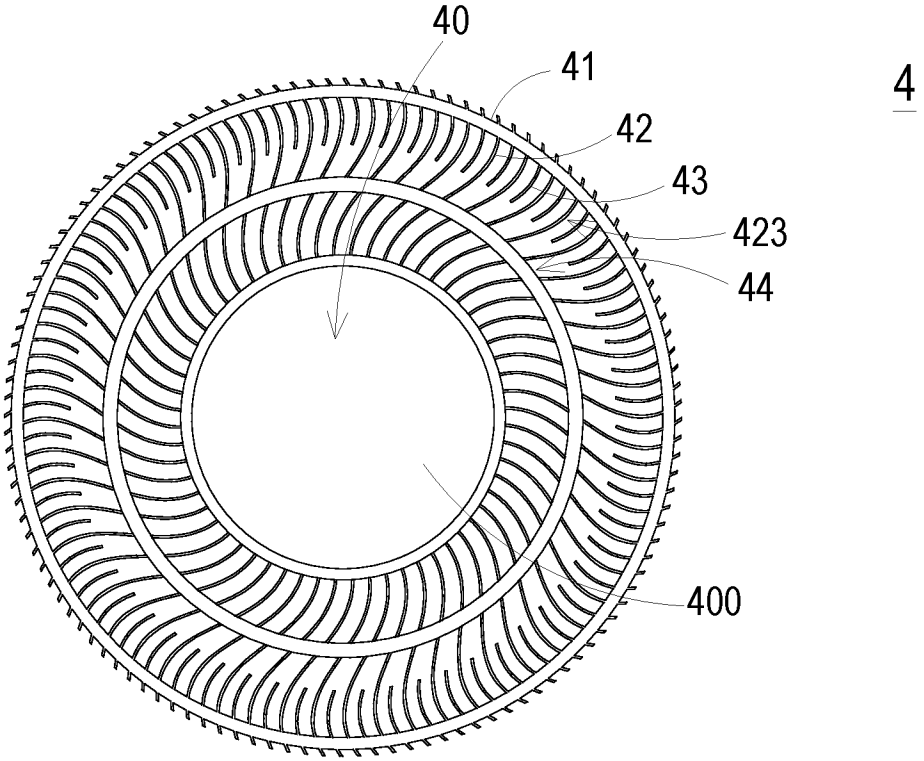
FIG. 5A is a schematic top view illustrating an impeller according to a third embodiment of the present disclosure.
Figure 5B:
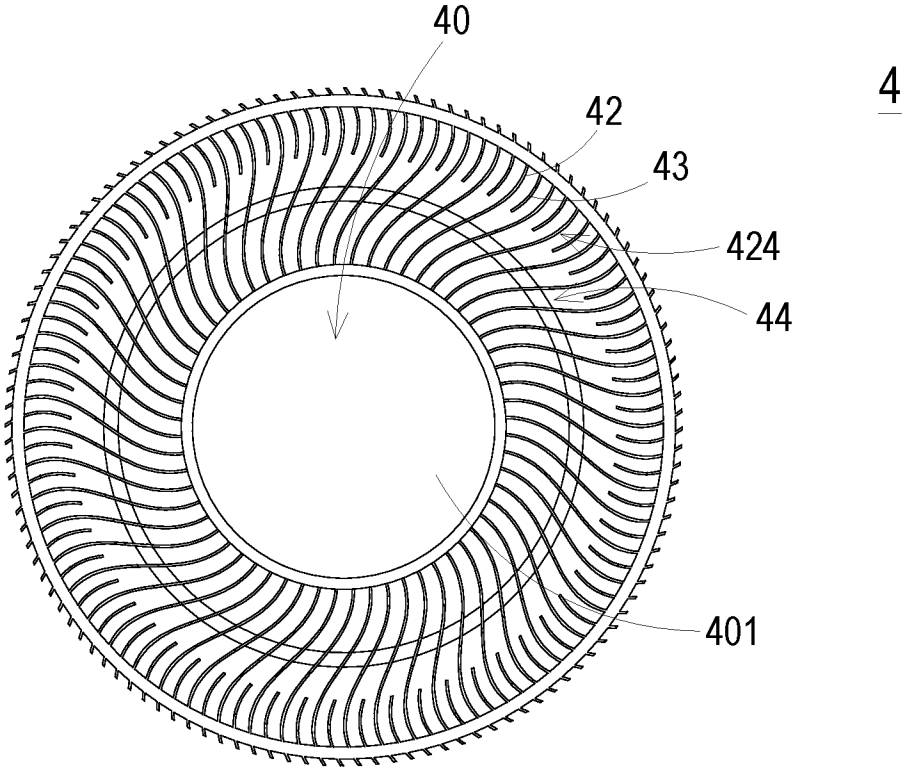
FIG. 5B is a schematic bottom view illustrating the impeller of FIG. 5A.

FIG. 5A is a schematic top view illustrating an impeller according to a third embodiment of the present disclosure, and FIG. 5B is a schematic bottom view illustrating the impeller of FIG. 5A. As shown in FIG. 5A and FIG. 5B, the impeller 4 comprises a hub 40, an outer ring 41, a plurality of first blades 42, and a plurality of second blades 43, wherein the structures and the arrangements of the hub 40, the outer ring 41, the plurality of first blades 42, and a plurality of second blades 43 are similar to the previously mentioned embodiments, and will not be redundantly repeated here. While in the embodiment, the impeller 4 further comprises an inner ring 44, and the inner ring 44 is arranged between the hub 40 and the outer ring 41, and each of the plurality of first blades 42 passes through the inner ring 44. In some embodiments, the inner ring 44 is arranged away from the hub 40, and a circumference of the inner ring 44 is smaller than the outer ring 41, and greater than 70% of the outer ring 41, but not limited thereto. In this embodiment, the hub 40 has a first surface 400, the first surface can be but not limited to be an upper surface, and is arranged correspondingly to the second surface 401. Moreover, a first side 423 of the plurality of first blades 42 is defined as the same side as the first surface 400 of the hub 40, and the corresponding side is defined as a second side 424. As shown in FIG. 5A and FIG. 5B, when the plurality of first blades 42 pass through the inner ring 44, the inner ring 44 is arranged on the first side 423 of the plurality of first blades 42, and on the contrary, there is no inner ring 44 on its opposite second side 424. The number and the position of the inner ring 44 are not limited to the above embodiments, which can be adjustable according the practical requirement.

Figure 6A:
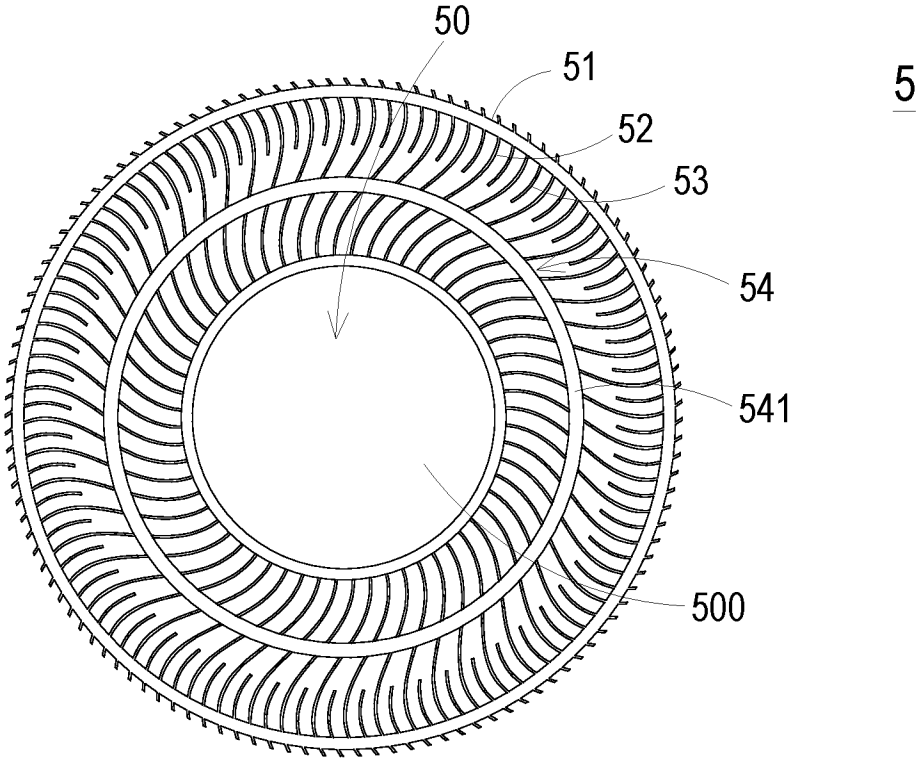
FIG. 6A is a schematic top view illustrating an impeller according to a fourth embodiment of the present disclosure.
Figure 6B:
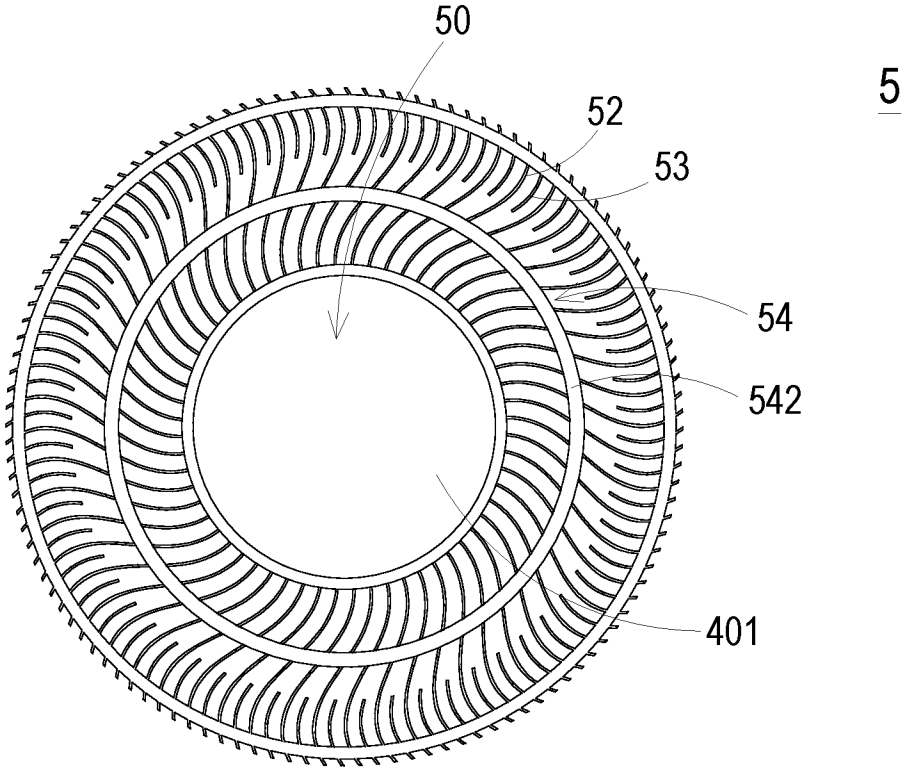
FIG. 6B is a schematic bottom view illustrating the impeller of FIG. 6A.

FIG. 6A is a schematic top view illustrating an impeller according to a fourth embodiment of the present disclosure, and FIG. 6B is a schematic bottom view illustrating the impeller of FIG. 6A. As shown in FIG. 6A and FIG. 6B, the impeller 5 comprises a hub 50, an outer ring 51, a plurality of first blades 52, and a plurality of second blades 53, wherein the structures and the arrangements of the hub 50, the outer ring 51, the plurality of first blades 52, and a plurality of second blades 53 are similar to the previously mentioned embodiments, and will not be redundantly repeated here. In this embodiment, the impeller 5 also has an inner ring 54, while in the embodiment, the number of the inner ring 54 is two, wherein the plurality of first blades 52 pass through the two inner rings 541, 542, and the two inner rings 541, 542 are respectively arranged on two corresponding sides of the plurality of first blades 52. In the embodiment, the two inner rings 541, 542 are arranged away from the hub 50, and a circumference of each inner ring 54 is smaller than the outer ring 51, and greater than 70% of the outer ring 51, but not limited thereto. In this embodiment, the hub 50 also has two corresponding first surface 400 and the second surface 401. As shown in FIG. 6A, when the plurality of first blades 52 pass through the inner ring 541, the inner ring 541 is arranged on a first side of the plurality of first blades 52, wherein the first side is the same side as the first surface 500 of the hub 50. As shown in FIG. 6B, when the plurality of first blades 52 pass through another inner ring 542, the inner ring 542 is arranged on a second side of the plurality of first blades 52, wherein the second side is the same side as the second surface 501 of the hub 50. Namely, in the embodiment, the two inner rings 541 and 542 are respectively arranged on the two corresponding sides of the plurality of first blades 52, and the positions of the two inner rings 541 and 542 are corresponding to each other. In some embodiments, the positions of the two inner rings 541 and 542 may not corresponding to each other, wherein the number and the positions of the two inner rings 541, 542 are not limited to the above embodiments, which can be adjustable according the practical requirement. Consequently, through the arrangement of the inner ring 54, the structure strength of the impeller 5 is enhanced, thereby the fan can be more stable and the vibration can be reduced during operation, and the effect of reducing noise is achieved.

From the above descriptions, the present disclosure provides an impeller. By the special arrangements of a plurality of main blades and a plurality of auxiliary blades, such as a staggered arrangement of the plurality of main blades and the plurality of auxiliary blades, so as to increase the blade density at the outer ring of the impeller, and to increase air volume and air pressure. Meanwhile, in cooperation with the guiding portion of the auxiliary blades, the airflow is more quickly and easily introduced into the fan. Moreover, through the arrangement of the inner ring, the structure strength of the impeller is enhanced, so that the fan can be more stable, and the vibration and noise can also be reduced during operation. Consequently, through the above structures and arrangements of the impeller, the fan can achieve the efficacy of increasing air volume and air pressure, and reducing the overall noise.

While the disclosure has been described in terms of what is presently considered to be the most practical and preferred embodiments, it is to be understood that the disclosure needs not be limited to the disclosed embodiment.

What is claimed is:

1. An impeller for using in a fan, comprising:

a hub;

an outer ring;

a plurality of first blades arranging around the hub at intervals, wherein each of the plurality of first blades passes through the outer ring, extends inward from the outer ring, and is connected to the hub;

a plurality of second blades arranging around the hub at intervals, wherein each of the plurality of second blades passes through the outer ring, and at least one of the plurality of second blades is disposed between the plurality of first blades, and each of the plurality of second blades includes a guiding portion, the guiding portion is an inclined plane, the inclined plane of the guiding portion is extended obliquely downward from a first side of the second blade, and a length of each of the plurality of second blades is between 10% and 45% of a length of each of the plurality of first blades; and two inner rings arranged between the hub and the outer ring, wherein each of the plurality of first blades passes through the two inner rings, and each of the plurality of second blades comprises a radially inward free end.

2. The impeller according to claim 1, wherein a connection end of each of the plurality of first blades is connected to a peripheral edge of the hub, and the connection end of each of the plurality of first blades has a fillet.

3. The impeller according to claim 1, wherein each of the plurality of second blades is arranged between every two adjacent of the plurality of first blades.

4. The impeller according to claim 1, wherein two of the plurality of second blades are arranged between every two adjacent of the plurality of first blades.

5. The impeller according to claim 1, wherein the hub has an axis, any point of tangency on one side edge of each of the plurality of first blades forms a line with the axis, and an angle is defined between the line and a tangent line of the point of tangency, and the angle is from 0 to 75 degrees.

6. The impeller according to claim 1, wherein the inclined plane is disposed on an inner end of each of the plurality of second blades.

7. The impeller according to claim 1, wherein a thickness of each of the plurality of first blades is not greater than 0.2 mm, and a thickness of each of the plurality of second blades is not greater than 0.15 mm.

8. An impeller for using in a fan, comprising:

a hub;

an outer ring;

a plurality of first blades arranging around the hub at intervals, wherein each of the plurality of first blades passes through the outer ring, extends inward from the outer ring, and is connected to the hub;

a plurality of second blades arranging around the hub at intervals, wherein each of the plurality of second blades passes through the outer ring, and at least one of the plurality of second blades is disposed between the plurality of first blades, and each of the plurality of second blades includes a guiding portion, the guiding portion is an inclined plane, the inclined plane of the guiding portion is extended obliquely downward from a first side of the second blade, and is disposed on an inner end of each of the plurality of second blades; and two inner rings arranged between the hub and the outer ring, wherein each of the plurality of first blades passes through the two inner rings, and each of the plurality of second blades comprises a radially inward free end.

9. The impeller according to claim 8, wherein a length of each of the plurality of second blades is between 10% and 45% of a length of each of the plurality of first blades.

10. The impeller according to claim 8, wherein a connection end of each of the plurality of first blades is connected to a peripheral edge of the hub, and the connection end of each of the plurality of first blades has a fillet.

11. The impeller according to claim 8, wherein each of the plurality of second blades is arranged between every two adjacent of the plurality of first blades.

12. The impeller according to claim 8, wherein two of the plurality of second blades are arranged between every two adjacent of the plurality of first blades.

13. The impeller according to claim 8, wherein the hub has an axis, any point of tangency on one side edge of each of the plurality of first blades forms a line with the axis, and an angle is defined between the line and a tangent line of the point of tangency, and the angle is from 0 to 75 degrees.

14. The impeller according to claim 8, wherein a thickness of each of the plurality of first blades is not greater than 0.2 mm, and a thickness of each of the plurality of second blades is not greater than 0.15 mm.

* * * * *